United States Patent [19]

Suzuki

[11] Patent Number: 4,678,133

[45] Date of Patent: Jul. 7, 1987

[54] AUTOMATIC CUTTING AND WINDING APPARATUS FOR A WEB-LIKE MATERIAL SUCH AS A FILM

[75] Inventor: Tsutomu Suzuki, Nagoya, Japan

[73] Assignee: Mitsubishi Jukogyo Kabushiki Kaisha, Tokyo, Japan

[21] Appl. No.: 799,736

[22] Filed: Nov. 19, 1985

[30] Foreign Application Priority Data

Nov. 30, 1984 [JP] Japan ..... 59-253090

[51] Int. Cl.[4] ..... B65H 19/20

[52] U.S. Cl. ..... 242/56 A

[58] Field of Search ..... 242/56 R, 56 A, 195

[56] References Cited

U.S. PATENT DOCUMENTS 2,256,082 9/1941 Feurt ..... 242/56 A
2,769,600 11/1956 Kwitek et al. ..... 242/56.6
3,942,735 3/1976 Marchio et al. ..... 242/56 R
4,458,852 7/1984 Calvert et al. ..... 242/56 A
4,487,377 12/1984 Perini ..... 242/56.8

*Primary Examiner*—Stuart S. Levy
*Assistant Examiner*—Joseph J. Hail, III
*Attorney, Agent, or Firm*—Wenderoth, Lind & Ponack

[57] ABSTRACT

In the known turret type automatic cutting and winding apparatus for automatically cutting a web-like material such as a film or the like, in order to make a cut end portion of the film adhere onto a circumferential surface of a new core without making use of an adhesive tape, electrostatic means is mounted on a swingable arm or arms, and thereby the cut end portion of the web-like material is given an electrostatic charge and is thus made to adhere onto the circumferential surface of the new core by an electrostatic force, resulting in elimination of slip between the cut end portion of the web-like material and the new core.

4 Claims, 9 Drawing Figures

AUTOMATIC CUTTING AND WINDING APPARATUS FOR A WEB-LIKE MATERIAL SUCH AS A FILM

BACKGROUND OF THE INVENTION

1. Field of the Invention

The present invention relates to an automatic cutting and winding apparatus for a web-like material such as a film, which automatically cuts a web-like material such as a film and continuously performs rewinding, and which is applicable to a biaxial oriented film manufacturing system, an unoriented film manufacturing system or the like.

2. Description of the Prior Art

A winding system for a web-like material such as an adhesive film (hereinafter called simply "film") in which a medium such as an adhesive tape is not used on a core but a film is wrapped directly around a core (hereinafter called "tapeless winding system") has been being given attention in various fields because damage of films in inner layers of a mill roll caused by unevenness of a core surface due to an adhesive tape or the like are not present and also a work of removing remaining adhesive materials upon reuse of the core is unnecessary. However, there still remain problems resulting in scratches being generated at a cut end of a film, and therefore, development of a more complete system has been strongly desired.

SUMMARY OF THE INVENTION

It is therefore one object of the present invention to provide a novel automatic cutting and winding apparatus for a web-like material such as a film in which an adhesive tape is not used on a core around which the web-like material is to be newly wound, but nevertheless the web-like material is made to embrace the core and is cut in such a way that scratches are not generated at the cut end portion of the web-like material.

According to one feature of the present invention, there is provided a turret type automatic cutting and winding apparatus for automatically cutting a web-like material by means of a press roll and for a cutter and winding it around a core, which apparatus comprises electrostatic charging means mounted on a swingable arm or arms for giving an electrostatic charge to a cut end portion of the web-like material.

Since the turret type automatic cutting and winding apparatus according to the present invention is constructed in the above-featured manner, upon cutting a web-like material and rewinding it on a new core, the swingable arm or arms and an electrostatic charge is given to a cut end portion of web-like material by the electrostatic charging means mounted on the swingable arm or arms, whereby the cut end portion of the web-like material adheres to the surface of the new core by an electrostatic attracting force, and simultaneously, winding of the web-like material around the new core is commenced. Therefore, slip does not occur between the surface of the new core and the cut end portion of the web-like material, and so, scratches are not generated at the cut end portion of the web-like material.

The above-mentioned and other objects, features and advantages of the present invention will become more apparent by reference to the following description of preferred embodiments of the invention taken in conjunction with the accompanying drawings.

DETAILED DESCRIPTION OF THE PRIOR ART

Figure 1:
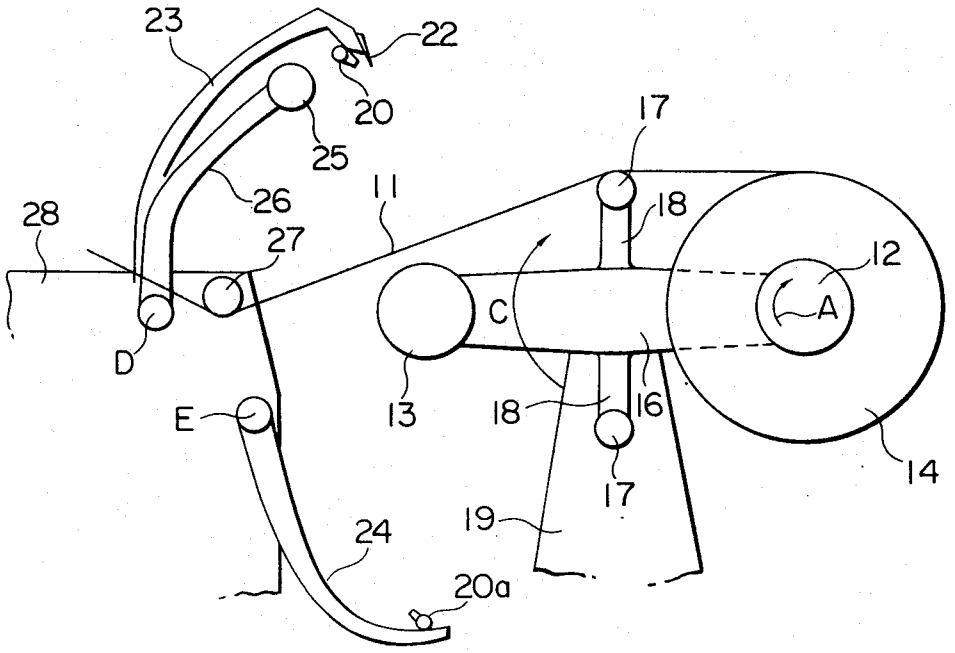
FIG. 1 is a schematic side view showing one preferred embodiment of the present invention in a state before cutting a film.
Figure 2:
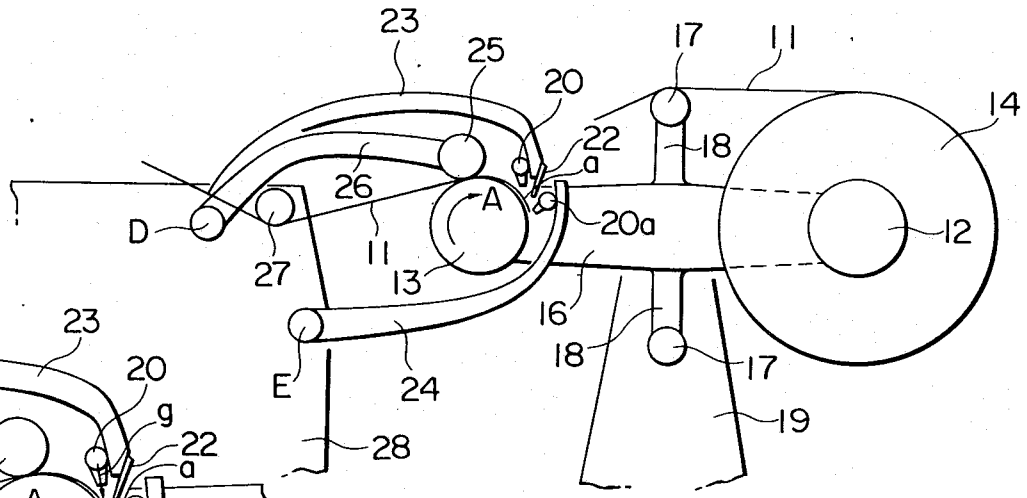
FIG. 2 is a schematic side view showing the same preferred embodiment but in a different state just after cutting a film.

Before entering the description of the preferred embodiments of the present invention, a construction and an operation of one example of a conventional turret type automatic cutting and winding apparatus for a film will be described in greater detail with reference to FIGS. 7 to 9. In these figures, reference numeral 1 designates a film, reference numeral 2 designates a new core around which a cut film is to be rewound, and this core 2 is mounted on one arm of a turret 4 so as to be rotationally driven in the direction of arrow A by means of a driving device not shown. Reference numeral 3 designates a guide roll that is pivotably supported at an end of another arm of the turret 4 that is angularly spaced apart by 90° from the arm on which the core 2 is mounted. Reference numeral 5 also designates a guide roll, which is pivotably supported at a film feed end of a frame 10. A swingable arm 7 pivotably supports at its tip end a wrapping roll 6, which can be revolved in the direction of arrow B so as to traverse a middle portion between the guide roll 5 and the core 2. The arm 7 is pivotably supported at the other end by one end of the frame 10 on the side of winding the film.

The above-mentioned wrapping roll 6 is adapted to revolve so as to traverse the middle portion between the guide roll 5 and the core 2 as described above and to reach the rear side of the core 2. Reference numeral 8 designates a cutter mounted at a tip end of an arm 9 which is likewise pivotably mounted at the other end to an appropriate position on the frame 10. This arm 9 is adapted to swing in synchronism with the revolution of the wrapping roll 6 by a driving device not shown and to cut the film 1 with the cutter 8 mounted at its tip end.

Figure 7:
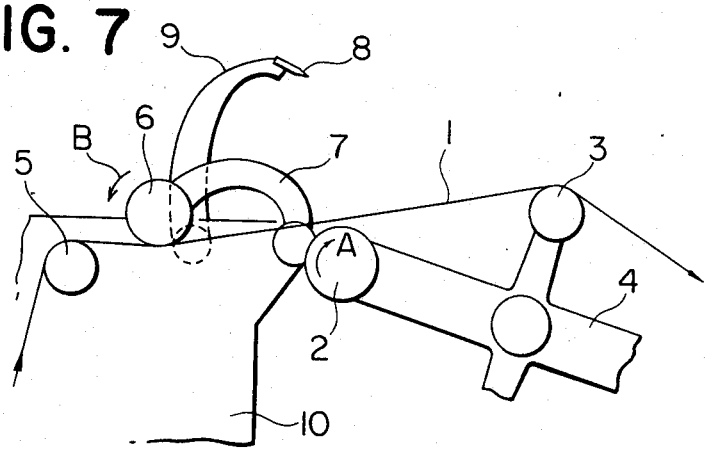
FIG. 7 is a schematic side view showing one example of a turret type automatic cutting and winding apparatus for a film in the prior art in a state where the film is being continuously wound around a last core.

Describing now the operation of the above-described apparatus, in FIG. 7, the film 1 is being continuously wound around a core (not shown) mounted at a remote end of the turret 4 on the opposite side to the end where the core 2 is mounted. If a mill roll being wound around that core reaches its full volume, then the wrapping roll 6 advances in the direction B so as to embrace the core 2 with the film 1, and the state shown in FIG. 8 is attained.

Figure 9:
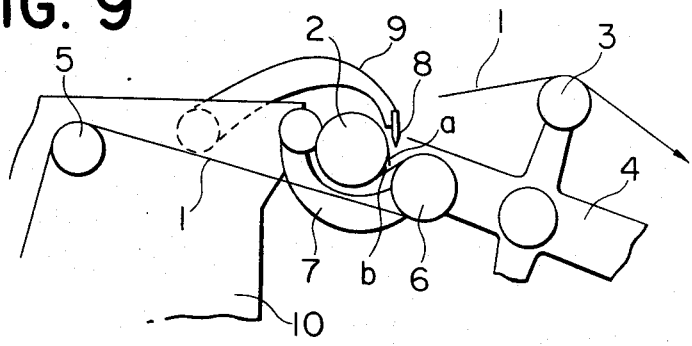
FIG. 9 is a schematic side view showing the same apparatus in the prior art but in a further different state just after cutting the film.

Subsequently, the cutter 8 descends to cut the film 1 as shown in FIG. 9, then a film end a is forced to enter a gap space b between the core 2 and the wrapping roll 6, and thereby wrapping is finished.

Figure 8:
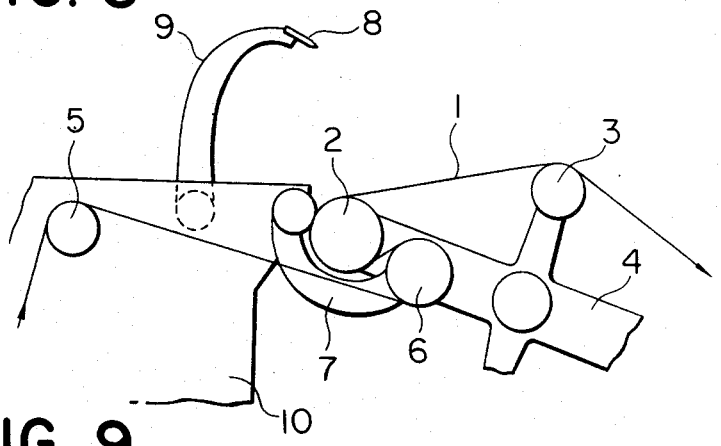
FIG. 8 is a schematic side view showing the same apparatus in the prior art but in a different state where the film is made to embrace a new core.

However, in the case of the prior art apparatus as described above, order to wrap in the cut end a of the film upon winding of the cut film around a new core in the above-described manner, it is necessary to embrace the core 2 with the film 1 prior to cutting as shown in FIG. 8. The film 1 is held under a predetermined tension generated for winding between the wrapping roll 6 and the guide roll 3 in FIG. 7, and so, upon transferrng from the state shown in FIG. 7 to the state shown in FIG. 8 it is necessary to gradually move the roll 6 over a large period of time, for the purpose of preventing breaking, zig-zag traveling, corrugation and the like of the film due to an unnatural force applied to the film 1.

But since the surface of the core 2 is not smooth as is the case with a smoothing roll, and since the circumferential speed of the core 2 is preset somewhat faster than the traveling speed of the film 1 in order to prevent slackening of the film immediately after the wrapping, slip would occur between the film 1 and the core 2, hence scratches are generated on the film 1, and so, the portion of the film scratched by the core 2 is unacceptable as a product. This loss amount would become larger as the film traveling speed becomes higher.

DESCRIPTION OF THE PREFERRED EMBODIMENTS

Now the present invention will be described in more detail in connection to preferred embodiments of the invention with reference to FIGS. 1 to 6.

A first preferred embodiment of the present invention is illustrated in FIGS. 1 to 4, in which reference numeral 11 designates a film, numerals 12 and 13 designate cores, and these cores 12 and 13 are pivotably supported from the opposite end portions of a turret 16 so as to be rotatably driven in the direction of arrow A by a driving device not shown, the turret 16 being mounted on a frame 19 so as to be rotatable about its center in the direction of arrow C. In addition, arms 18 are provided on the opposite sides of the central portion of the turret 16 to project therefrom, and at the respective tip end portions of the arms 18 are pivotably supported guide rolls 17, respectively. Reference numeral 14 designates a mill roll formed by winding the film 11 around the core 18.

On the film feed side of the above-described frame 19 is disposed another frame 28 on which a pivotably mounted a guide roll 27 is disposed alongside a film feed passageway. Also on the frame 19, adjacent to the guide roll 27, are pivotably mounted swingable arms 26 and 23 which can swing about the same axis D. The swingable arm 23 has electrostatic charging means 20 and a cutter 22 mounted at its tip end portion, and a press roll 25 is pivotably mounted at the tip end portion of the swingable arm 26. In addition, a similar swingable arm 24 having electrostatic charging means **20*a* mounted at its tip end portion is pivotably mounted on the same frame 28 under the above-described guide roll 27 so as to swing about point E. For the electrostatic charging means 20 and 20*a***, electrode sections of the well-known blast type electrostatic charging devices such as, for example, the heretofore commonly used devices in which ionized air produced by corona discharge between high-voltage electrodes is blasted by a blower or a compressor, are employed. It is to be noted that a power supply section and wirings of the electrostatic charging device are omitted from illustration.

Figure 3:
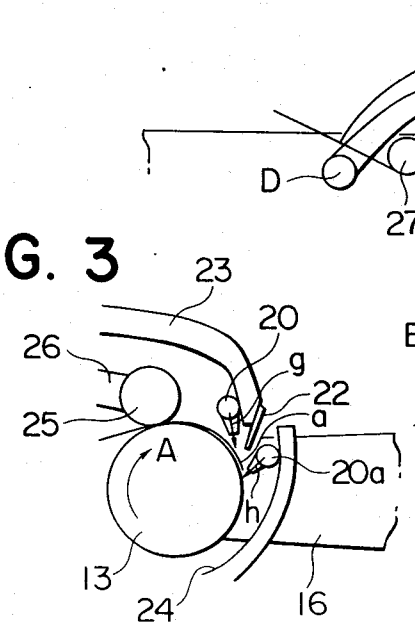
FIG. 3 is an enlarged schematic side view showing an essential part of the embodiment in FIG. 2.

Now description will be made of the operation in the case where tapeless winding of a film is carried out by making use of the apparatus according to the above-described embodiment of the present invention. FIG. 1 shows the state of the apparatus at the time when the mill roll 14 on the right-side core 12 as viewed in the figure has reached a full amount. The wound length of the film 11 is measured by a wound length counter not shown, and when it has reached the full amount, the arm 24 is actuated to assume the position shown in FIG. 2. Subsequently the arms 23 and 26 are actuated to cut the film 11 with the cutter 22 and to simultaneously press the film 11 against the new core 13 by means of the press roll 25. Furthermore, simultaneously with the cutting, ionized air is blasted from the blast type electrostatic charging means 20 and **20*a* towards the cut end portion a of the film 11 in the directions of arrows g and h. Thus the cut end portion a of the film 11 is pressed against the core 13 by the wind force as it is charged, and thereby winding of the film 11 is carried out with the cut end portion a of the film 11 adhering to the core 13 and automatic cutting and rewinding can be achieved in a tapeless system (FIG. 3**).

Figure 4:
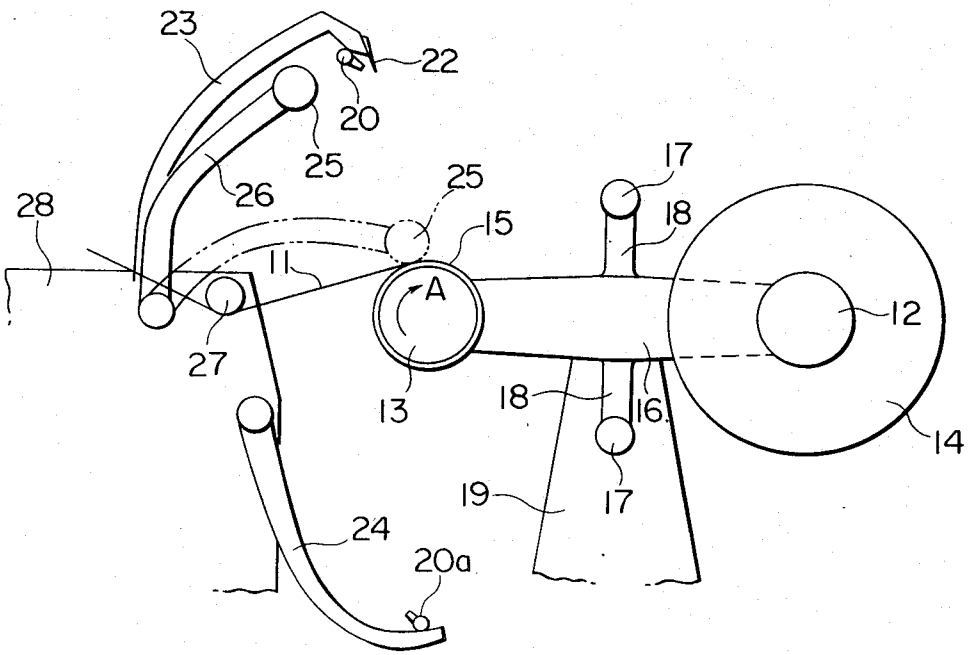
FIG. 4 is a schematic side view showing the same preferred embodiment but in a further different state where a film is being continuously wound around a new core.

Once wrapping of the cut end portion a of the tape 11 around the new core 13 has been finished, the arms 23, 24 and 26 are again actuated to return to the state shown in FIG. 4, and winding of the film 11 is carried out on the new core 13 to form a mill roll 15. It is to be noted that so long as it is possible to realize the state shown in FIG. 2 upon cutting the film 11, the sequence of actuations of the respective arms 23, 24 and 26 is immaterial.

Figure 5:
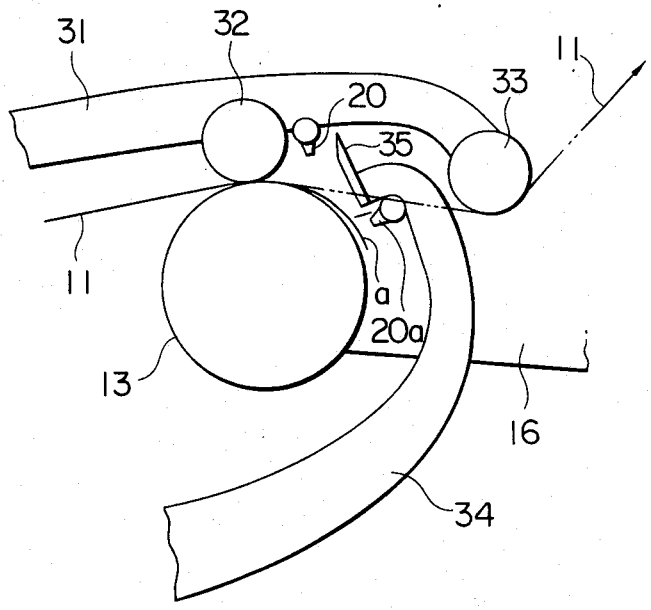
FIG. 5 is an enlarged schematic side view showing an essential part of another preferred embodiment of the present invention in a state just after cutting a film.
Figure 6:
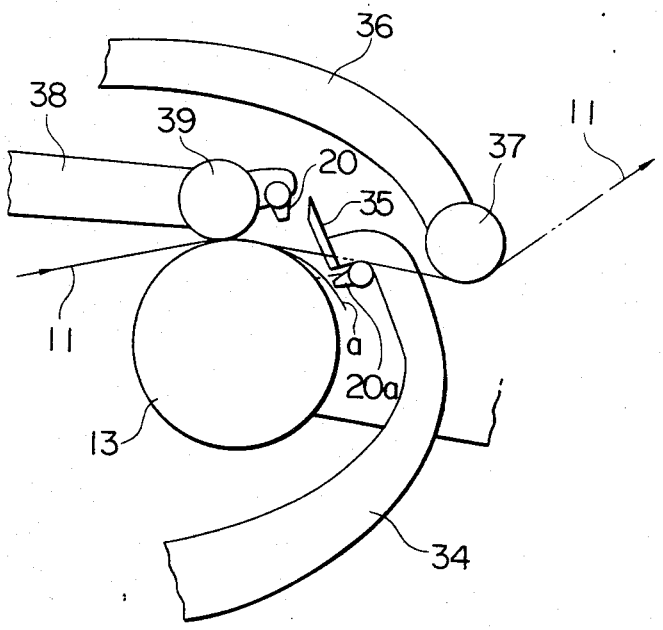
FIG. 6 is an enlarged schematic side view showing an essential part of still another preferred embodiment of the present invention in a state just after cutting a film.

Now description will be made of different preferred embodiments of the present invention, especially with respect to the points different from the above-described first preferred embodiment. FIGS. 5 and 6, respectively, show different modified embodiments of the present invention.

At first, describing the preferred embodiment illustrated in FIG. 5, a cutter 35 is mounted at a tip end of an arm 34 which corresponds to the arm 24 in the first preferred embodiment, only one upper swingable arm 31 is provided, a press roll 32 being pivotably supported at the middle of the arm 31, a guide roll 33 also being pivotably supported at the tip end portion of the arm 31, and electrostatic charging means 20 being mounted on the arm 31 close to the press roll 32 on the side of the guide roll 33. With regard to the remainder of the apparatus, the construction is identical to the first preferred embodiment.

By employing the above-described construction, when the arm 34 has been made to swing to the position shown in FIG. 5, the stop position of the cutter 35 can be made as close as possible to the core 13 for the purpose of minimizing the length of the film end portion a. Thereafter, the arm 31 is also lowered to the position shown in FIG. 5, to press the film 11 onto the cutter 35 at a high speed by the rolls 32 and 33, and thereby the film 11 can be cut. Simultaneously with cutting, ionized air is blasted from the electrode sections 20 and **20*a* of the electrostatic charging means onto the cut end portion a of the film 11. Thus, the charged cut end portion a of the film 11 is made to adhere to the core 13, and then winding of the film 11 around the core 13** is carried out.

When the wrapping of the cut end portion a of the film 11 around the core 13 has been finished, the arms 31 and 34 respectively ascend and descend. It is to be noted that either the arm 31 could descend first and subsequently the arm 34 could ascend to cut the film 11 or the arms 31 and 34 could be actuated simultaneously.

FIG. 6 shows still another preferred embodiment of the present invention. Differences between this preferred embodiment and the above-described embodiment illustrated in FIG. 5 exist in that the single arm 31 in FIG. 5 is modified into two arms 36 and 38, a guide roll 37 is mounted at the tip end of the arm 36, electrostatic charging means 20 is mounted at the tip end of the other arm 38, and a press roll 39 is pivotably supported from the same arm 38 close to the electrostatic charging means on its inner side. With regard to the remainder of the apparatus, the construction is identical to the preferred embodiment shown in FIG. 5.

Describing now the operation of the modified embodiment shown in FIG. 6, after the arm 34 ascends to the position shown in FIG. 6, the arm 38 descends to press the roll 39 against the core 13, at the same time the arm 36 descends to bring the guide roll 37 into contact with the film 11, and while a tension is being applied to the film 11 by the arm 36 and the guide roll 37, the cutter 35 is pressed against the film 11 to cut it. Similarly to the embodiment shown in FIG. 5, simultaneously with cutting of the film 11, ionized air is blasted from the electrode sections 20 and 20*a* of the electrostatic charging means onto the cut end portion a of the film 11 to charge it. Thus, the cut end portion is made to adhere to the core 13, and then winding of the film 11 around the core 13 is carried out. In the above-mentioned operation, the arm 34 could swing prior to the swing motions of the arms 36 and 38, or else, all the arms 34, 36 and 38 could be actuated simultaneously to cut the film 11.

In the above-described respective embodiments, the press rolls 25, 32 and 39 can be used as a lay-on roll for controlling winding hardness of the mill roll. Moreover, without employing the blasting of ionized air, the cut end portion of the film could be made to adhere to the core only by giving electrostatic charge onto the cut end portion. If necessary, only one electrostatic charging device can be employed (for instance), the electrode section 20 only), or three or more. Still further, the cut end portion of the film could be wrapped around the core by separately performing electrostatic charging and air-blasting for pressing. For instance, an electrostatic charging electrode section could be provided at the mount position of the electrode section 20, and an air-blasting nozzle section could be provided at the mount position of the electrode section 20*a*.

As described in detail above, according to the present invention, since the cut end portion of the film is pressed against a core by air-blasting while the film is cut, and the film is made to adhere to the core by charging the film, tapeless winding system is provided in which there is no need to embrace the core with the film prior to cutting. Hence, in the final portion of winding of a mill roll, a film section which comes into contact with the core and is subjected to scratching damage, resulting in loss of a yield, can be eliminated, and so, a yield of a film is greatly improved. It is to be noted that this effect becomes more remarkable as the winding speed of a film becomes faster.

Since many changes and modifications in design can be made to the above-described construction without departing from the spirit of the present invention, it is intended that all matter contained in the above description and illustrated in the accompanying drawings shall be interpreted as illustrative and not in a limiting sense.

What is claimed is:

1. A turret type automatic cutting and winding apparatus for automatically cutting a continuous web as the web is maintained in pressing engagement against a rotating winding core by a press roller, and for wrapping the web around the rotating winding core, said apparatus comprising:

a frame;

a cutter for cutting the web across the entire width thereof, said cutter being movable to a position adjacent the winding core downstream from the press roller for cutting the web thereat to form a leading free end of the web;

electrostatic charging means movable to a position adjacent the winding core downstream from the press roller for applying an electrostatic charge to the leading free end of the web such that the leading free end of the web is attracted to adhere against the winding core; and swingable arm means pivotably mounted to said frame and on which said cutter and said electrostatic charging means are mounted, said swingable arm means pivoting between first and second positions to move said cutter and said electrostatic charging means to said positions adjacent the winding core respectively.

2. An apparatus as claimed in claim 1, and further comprising a first swingable arm pivotably mounted to said frame and on which the press roller is mounted, said first swingable arm movable to a first position to place the press roller mounted thereon against the web and the winding core to establish said pressing engagement; and wherein said swingable arm means comprises a second swingable arm pivotably mounted to said frame and on which said electrostatic charging means and said cutter are mounted, said second swingable arm pivotable from a first position above the web downward to a second position to place said electrostatic charging means and said cutter mounted thereon at said position adjacent the winding core, and a third swingable arm pivotably mounted to said frame and on which said electrostatic charging means is mounted, said third swingable arm pivotable from a first position below the web upward to a second position to place said electrostatic charging means mounted thereon at said position adjacent the winding core.

3. An apparatus as claimed in claim 1, wherein said swingable arm means comprises a first swingable arm pivotably mounted to said frame, said first swingable arm having the press roller and a tensioning roller rotatably mounted thereto and said electrostatic charging means mounted thereon, said first swingable arm pivotable from a first position above the web downward to a second positon adjacent the winding core at which the press roller presses against the web and the winding core to establish said pressing engagement, the tension roller presses against the web to tension the web between the press roller and said tension roller, and said electrostatic charging means is at said position adjacent the winding core, and a second swingable arm pivotably mounted to said frame and on which said cutter and said electrostatic charging means are mounted, said second swingable arm movable between a first position below the web upward to a second position at which said cutter cuts the web tensioned between the press roller and said tension roller and said electrostatic charging means mounted thereon is at said position adjacent the winding core.

4. An apparatus as claimed in claim 1, wherein said swingable arm means comprises a first swingable arm pivotably mounted to said frame and on which the press roller is rotatably mounted and said electrostatic charging means is mounted, said first swingable arm pivotable from a first position above the web downward to a second position at which the press roller presses against the web and the winding core to establish said pressing engagement and said electrostatic charging means is at said position adjacent the winding core, and a third swingable arm pivotably mounted to said frame and on which said cutter and said electrostatic charging means are mounted; and further comprising a second swingable arm on which a tension roller is rotatably mounted, said second swingable arm movable between a first position above the web downward to a second position at which the tension roller presses against the web while the web is maintained in said pressing engagement by the press roller thereby tensioning the web between the press roller and said tension roller; and said third swingable arm movable between a first position below the web upward to a second position at which said cutter cuts the web across the entire width thereof tensioned between said tension roller and the press roller and said electrostatic charging means mounted thereon is at said position adjacent the winding core.

* * * * *